US008022884B2

(12) United States Patent
Dumon et al.

(10) Patent No.: US 8,022,884 B2
(45) Date of Patent: Sep. 20, 2011

(54) CIRCULARLY OR LINEARLY POLARIZED ANTENNA

(75) Inventors: Patrick Dumon, Vigoulet-Auzil (FR); Luc Duchesne, Angervilliers (FR); Marc Le Goff, Les Ulis (FR); Nicolas Gross, Bourg la Reine (FR); Philippe Garreau, Mennecy (FR)

(73) Assignees: STE d Applications Technologiques de l Imagerie Micro-Onde, Villebon sur Yvette (FR); Centre National d Etudes Spatiales, Paris (FR)

( * ) Notice: Subject to any disclaimer, the term of this patent is extended or adjusted under 35 U.S.C. 154(b) by 249 days.

(21) Appl. No.: 12/162,649

(22) PCT Filed: Feb. 1, 2007

(86) PCT No.: PCT/EP2007/050999

§ 371 (c)(1),
(2), (4) Date: Jul. 30, 2008

(87) PCT Pub. No.: WO2007/088191

PCT Pub. Date: Aug. 9, 2007

(65) Prior Publication Data

US 2009/0002254 A1 Jan. 1, 2009

(30) Foreign Application Priority Data

Feb. 1, 2006 (FR) ..... 06 00900

(51) Int. Cl.
*H01Q 11/12* (2006.01)

(52) U.S. Cl. ..... 343/742; 343/728; 343/729

(58) Field of Classification Search ..... 343/860, 343/742, 728, 729
See application file for complete search history.

(56) References Cited

U.S. PATENT DOCUMENTS

| | | | | |
|---|---|---|---|---|
| 2,521,550 | A | 9/1950 | Smith | |
| 3,680,135 | A * | 7/1972 | Boyer | 343/742 |
| 6,590,543 | B1 * | 7/2003 | Apostolos | 343/742 |
| 2005/0280599 | A1 * | 12/2005 | Le Goff et al. | 343/895 |

FOREIGN PATENT DOCUMENTS

| | | |
|---|---|---|
| EP | 0 512 876 A1 | 11/1992 |
| FR | 2 841 388 A1 | 12/2003 |

OTHER PUBLICATIONS

International Search Report for International Application No. PCT/EP2007/050999, mailed May 25, 2007.

* cited by examiner

*Primary Examiner* — Jacob Y Choi
*Assistant Examiner* — Kyana R McCain
(74) *Attorney, Agent, or Firm* — Alston & Bird LLP

(57) ABSTRACT

The invention relates to an antenna that produces a radiation pattern that is axisymmetric about a geometrical axis (X) and exhibits a radiation maximum in a plane perpendicular to the direction of said X axis that includes a feed wire extending along said axis (X) from a first end situated level with a conducting surface forming an earth plane of the antenna to a second end that feeds a set of N radiating strands, N being an integer, characterized in that it also includes at least one earth return rod for the strands, said rod linking one of the radiating strands of the set to the earth plane.

14 Claims, 3 Drawing Sheets

CIRCULARLY OR LINEARLY POLARIZED ANTENNA

The invention relates to circularly or linearly polarized antennas and more specifically to antennas having a radiation pattern which is axisymmetric about an axis and having a radiation maximum in the plane perpendicular to the direction of this axis.

The invention more particularly but not as a limitation, relates to plated (patch) technology antennas.

This widely spread technology has important applications in fields such as aeronautics, the space industry or further civil and military communications.

Plated or printed antennas group the whole of the aerials made according to a technology consisting of placing on a dielectric substrate a conductive pattern fed through a feed wire above a ground plane.

This conductive pattern, of reduced dimensions, forms the radiating component of the antenna and may be in the shape of a square, a rectangle, a disc or even a ring, or another shape.

Today, there are also antennas, the conductive pattern of which for example appears as a set of radiating strands substantially located in a same main plane, and fed through a same feed wire parallel to the axis of revolution of the radiation pattern of the antenna, each of the strands following an initial segment radial with respect to this axis perpendicular to the main plane, and then each of the strands extending along a circular arc centered on this axis, and then again following a substantially radial segment directed towards this axis, thereby housing a radial segment of the neighboring strand without touching it.

These printed antennas have a further limited passband.

Further, the fields of application of these aerials require antennas with increasingly reduced bulkiness.

One of the objects of the invention is to improve existing antennas.

Another object of the invention is to propose an antenna with reduced dimensions retaining equivalent performances at equal frequencies as compared with antennas of larger dimensions.

Another object of the invention is to propose an antenna having particularly clear natural circular polarization or natural linear polarization.

It is also desirable to provide a simplified antenna on the manufacturing level, which is easy to manufacture and has reduced production costs.

Another object of the invention is to propose an antenna which may be very simply combined with other antennas and particularly with a GPS or satellite geopositioning type antenna.

These as well as other objects, which will become apparent in the following, are achieved by means of an antenna producing an axisymmetric radiation pattern around a geometrical axis (X) and having a radiation maximum in a plane perpendicular to the direction of said X axis including a feed wire extending along said axis (X) from one first end located at a conductive surface forming a ground plane of the antenna towards a second end powering a set of N radiating strands characterized in that it also includes at least one ground return rod for the strands, said rod connecting one of the radiating strands of the set to the ground plane.

Such an antenna may be made in plated technology or in wire technology.

With its structure, it is possible to promote an increase of the radiation frequency band and to improve the mechanical robustness of the assembly.

Certain preferred aspects, but non-limiting aspects of the method according to the invention, are the following:

- an initial segment and/or a return branch forming a radiating strand comprises at least one meander;
- the feed wire of the radiating strands is formed by a rectilinear rigid wire or comprising at least one meander;
- the antenna further includes an external antenna support as a conductive disc connected in its centre to the feed wire and at the periphery to each of the N radiating strands of the antenna;
- the antenna includes an impedance matching circuit in the form of a disc centered on the X axis and placed at said first end of the feed wire forming a capacitance with the ground plane.

The invention will be better understood and other advantages will become apparent upon reading the detailed description which will follow, given as a non-limiting example and by means of the appended drawings wherein.

1. Structure of an Antenna

Figure 1:
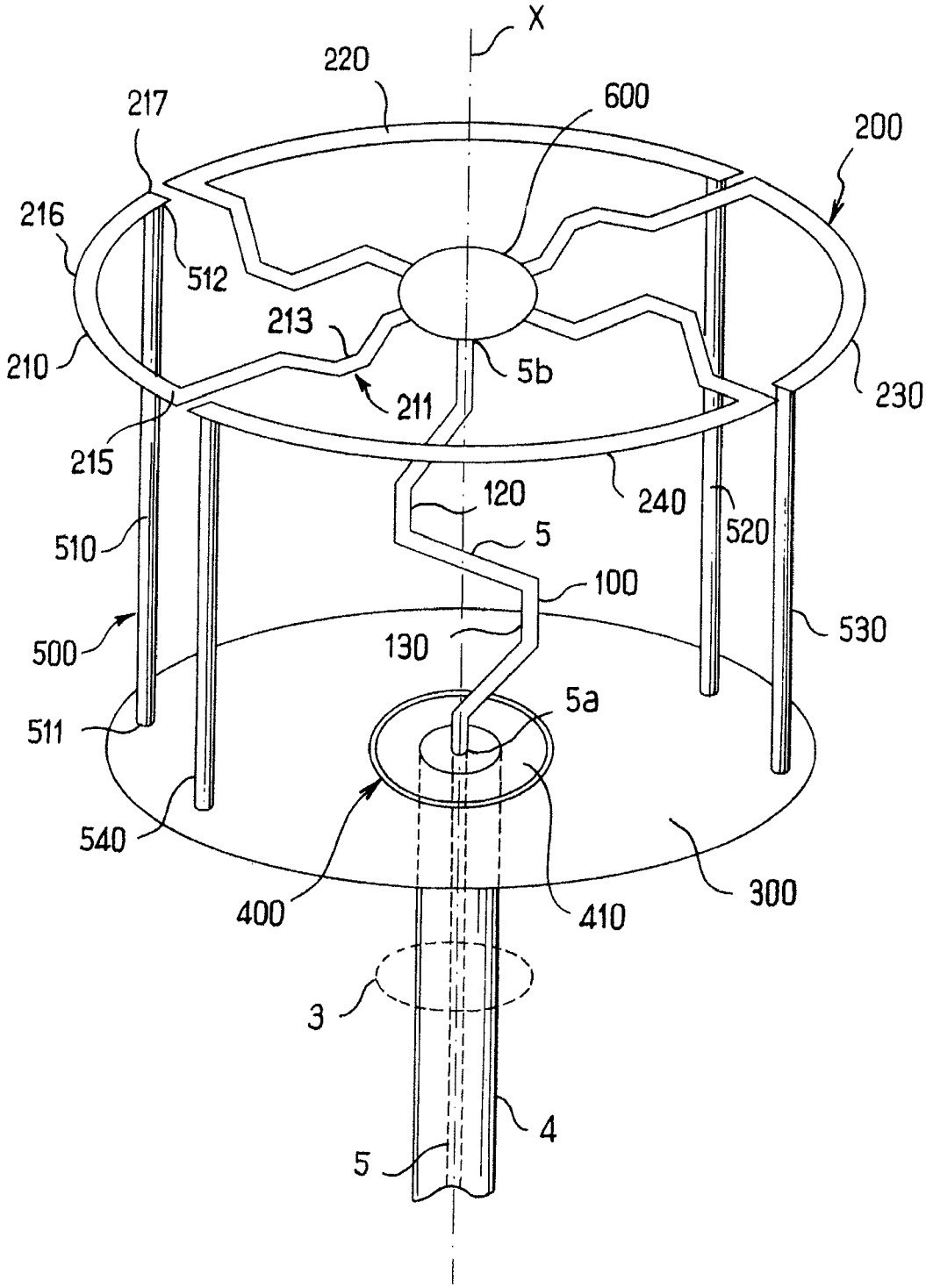
FIG. 1 illustrates in a perspective view an antenna according to a first alternative of the invention.

The antenna of FIG. 1 is a printed antenna producing an axisymmetric radiation pattern around a geometrical axis X, the radiation maximum of this pattern appearing in a plane perpendicular to the direction of this axis (in the following, this axis will be considered vertical by convention and by convenience for the description).

The antenna consists of four main components, i.e. a set 200 of N identical radiating strands (N being an integer), a ground plane 300, a set 500 of N ground return rods for the rigid strands and a feed wire 100.

The set 200 of N radiating strands referenced as 210, 220, 230, 240, geometrically centered on the geometrical axis X, is located in a main plane perpendicular to said X axis.

The ground plane 300, essentially axisymmetric around the X axis, is, as for it, placed parallel to the main plane of the set 200 of N radiating strands.

On the other hand, the N ground return rods of the strands of the set 500 referenced as 510, 520, 530, 540, are each respectively associated with a radiating strand 210, 220, 230, 240, and connect them to the ground plane 300.

They extend parallel to the X axis exactly like the feed wire 100 which extends along this axis from a first end 5*a* located at the ground plane 300 of the antenna towards a second end 5*b* powering the set 200 of N radiating strands.

a. The Ground Plane

As regards the conductive surface forming a ground plane 300, the latter may assume several shapes. It may thus be either planar or not and formed by either a continuous structure or not.

This surface playing the role of a reflector, should at least be axisymmetric so that the radiation pattern of the antenna also has this characteristic.

This ground plane 300 is electrically connected to the reinforcement 4 of a coaxial conductor 3 also comprising a central core 5, said coaxial conductor 3 forming a source for powering the antenna.

b. The Feed Wire

The central core 5 of the coaxial conductor 3, set to a potential different from that of the reinforcement 4, extends beyond the ground plane 300, towards the set 200 of N radiating strands in order to form the feed wire 100.

This wire 100 stops at the set 200 of N radiating strands. As for the reinforcement 4, it does not extend beyond the ground plane 300.

The feed wire 100 is thus excited at the end 5*a* by the coaxial conductor 3 and loaded by the set 200 of the N radiating strands at the opposite end 5*b*.

Moreover, in order to reduce the dimensions of the antenna and more specifically its height, the feed wire 100 may comprise one or several meanders 120, 130 with various shapes and dimensions.

Further, the meanders 120, 130 may either be contained or not in different planes on the one hand and contained in planes either containing the X axis of symmetry or not on the other hand.

In FIG. 1, the feed wire 100 comprises a series of two inverted trapezoidal meanders 120 and 130 located on either side of the geometrical axis X in an identical plane containing this axis.

Moreover, the feed wire 100 at its end 5*b* may be connected to an external antenna support.

This support appears as a conductive solid disc 600 coaxial with the X axis, and electrically connected at its periphery to the coplanar set 200 of the N radiating strands.

This support is capable of receiving an external antenna on the upper face of the disc 600, a face opposite to the ground plane 300. For example, mention may be made of the positioning of a GPS type antenna on said support.

It should be noted that no current flows between both juxtaposed antennas, the GPS antenna being attached onto the disc 600 by adhesive tape, spacers or any other known non-conductive attachment means.

Further, the power supply of the GPS antenna may be placed either inside or outside the feed wire 100.

c. The Set of N Radiating Strands

As regards the radiating components, the set 200 in FIG. 1, comprises four strands 210, 220, 230, 240, which have a shape similar to that of the radiating strand 210 described now.

Starting from the periphery of the disc 600, the radiating strand 210 first consists of an initial segment 211 extending radially from the disc 600. This segment is extended by a circular arc portion 216 which extends over 90° around the X axis in the reverse trigonometric direction (clockwise) direction.

More generally, for a set 200 of N radiating strands, the portion 216 extends over a circular arc of 360°/N. Further, each of the N radiating strands has the same configuration, the circular arc portion 216 turning around the X axis in a same direction (anticlockwise or clockwise) for each strand.

In order to reduce the dimensions of the antenna, the initial segment 211 of the radiating strand 210 may advantageously include one or more meanders 213, the shape and dimensions of which may be varied.

As non-limiting examples, mention may be made of meanders of the trapezoidal and/or square and/or rectangular and/or triangular and/or circular arc type and/or of another geometrical shape.

In FIG. 1, the initial segment 211 comprises a meander with a general trapezoidal shape 213 (a general flared U-shape).

Moreover, preferably, the set 200 of the radiating strands is found at a distance from the ground plane 300 which is of the order of 0.02λ to 0.04λ, where λ is the preferential working wavelength for this antenna. Further, the diameter of the radiating strands is substantially identical with the external diameter of the ground plane 300.

d. The Ground Return Rod(s) for the Strands

As regards the ground return rods for the strands 510, 520, 530, 540, they are all identical with the ground return rod of the strand 510 associated with the radiating strand 210 which is now presented.

This rectilinear rod 510 is electrically connected at one end 512, to the end 217 of the circular arc portion 216 of said strand and at the opposite end 511, to the ground plane 300.

In addition to their electric function, each ground return rod 510, 520, 530, 540, plays a mechanical role and at least partly supports the antenna.

On the other hand, their presence promotes increase in the radiation frequency band of the antenna and increases the mechanical robustness of the assembly.

e. Other Components of the Antenna

In order to increase the performances of the antenna, an alternative embodiment provides the use of an impedance matching device 400.

This device 400 comprises a disc 410 centered on the X axis and placed at the end 5*a* of the feed wire 100 in contact with the central core 5 of the coaxial conductor 3, without however being connected to the ground plane 300. The space between the disc 410 and the ground plane 300 may be occupied by air or a dielectric.

This disc 410 forms with the ground plane a capacitance.

Preferably, it has a thickness of the order of 0.5 mm.

Moreover, an alternative embodiment of the antenna provides that the coaxial conductor 3 may be replaced by another power supply source made with a circuit in printed planar technology.

It should be noted that a power supply according to this technology may be placed in any location of the antenna, for example in the main plane of the radiating strand, on the ground plane 300 or like for the antenna illustrated in FIG. 1 beyond the ground plane 300 opposite to the set 200 of four radiating strands 210, 220, 230, 240.

Advantageously, the powering of the antenna is in any case performed through a single wire and no additional phase shift circuit is required, which makes it a simple structure to produce both from the electrical point of view and from the mechanical point of view.

2. Operating Principle of an Antenna

The operating principle of the antenna is the following.

It is recalled that the geometrical X axis is the axisymmetric axis of the radiation pattern of the antenna.

A maximum of radiation is emitted towards the horizon, i.e. axially around the X axis and in the direction of the main plane of the strands, whereas a radiation minimum is present in the direction defined by the axis of symmetry X.

Over a sufficiently wide relative operating frequency band (>10%), the antenna either generates natural circular polarization or natural linear polarization according to the working frequency and the geometry of the antenna.

Over this frequency band, the central portion of the antenna, and in particular the feed wire 100, excited by the coaxial conductor 3 and loaded by the set 200 of N radiating strands, generates a vertically polarized electromagnetic field component along the X axis with a maximum at the horizon.

The peripheral portion of the antenna and, more specifically, the set 200 of the N radiating strands, as for it, generate a horizontally polarized electromagnetic field component with also a maximum at the horizon.

According to the geometry of the antenna (dimensions, clockwise or anticlockwise winding) and to the working frequency, a 90° or −90° phase shift and same amplitude may be obtained between both of these radiated components.

The composition of the different radiations then produces circular polarization observed with a radiation maximum directed towards the horizon.

Moreover, for certain working frequencies, the antenna may be excited with only one of the two radiations.

A linear polarization is then produced with a radiation maximum directed towards the horizon.

The linear polarization may thus either be vertical and parallel to the X axis or horizontal and parallel to the main plane of the radiating strands 210, 220, 230, 240.

Natural circular or linear polarization is therefore obtained with a radiation maximum directed towards the horizon, the winding direction of the radiating strands setting the main polarization.

In FIG. 1, the clockwise winding direction implies right circular polarization at a given working frequency.

With the dimensions of the ground plane 300, it is also possible to influence the radiation properties of the antenna such as the gain, the polarization or further the direction of the radiation maximum.

For example, in the case shown here, where the ground plane 300 has a diameter comparable to that of the circular perimeter formed by the radiating strands 210, 220, 230, 240 whether this be with circular or linear polarization, the gain obtained with this antenna is typically of the order of 1 dB to 2 dB for elevational angles (direction of the radiation maximum with respect to the horizontal) comprised between 0° and 60° C.

Moreover, each radiating strand 210, 220, 230, 240, has a length less than or equal to half a wavelength λ at the preferential frequency for this antenna.

In order to widen the operating frequency band, additional radiating strands may be superimposed onto the set of N initial strands.

These additional radiating strands may either be electrically connected or not to the initial strands and may either be of the same dimensions or not as the initial strands.

A multifrequency operating mode is also possible either by stacking several sets 200 of radiating strands, preferentially along parallel planes and of different diameters, or by a multiplexer connected to the set 200 of four radiating strands or by combining both of these solutions.

The present antenna is very compact here and has dimensions reduced by the presence of meanders.

Thus, the outer diameter of the circle consisting of the radiating strands 210, 220, 230, 240 is of the order of 0.10λ to 0.25λ, where λ is the preferential working wavelength of the antenna.

With such a small diameter, reduced bulkiness of the antenna may be achieved with regard to the wavelength.

On the other hand, the total thickness of the antenna is very small as compared to the wavelength.

This thickness, defined by the height of the plane of the radiating strands with respect to the ground plane, is typically of the order of 0.02λ to 0.04λ.

Further, the mass of this antenna may be very small by selecting a suitable material. It is typically of the order of 150 grams at a frequency of 400 MHz.

Moreover, as regards the making of this printed antenna, with its structure, it may easily be made by mass production at low costs.

The space between the radiating strands and the mass ground plane may be occupied by a dielectric material.

However, it should be noted that an antenna according to the invention may also be made in metal on air.

3. Other Embodiments of an Antenna

Figure 2:
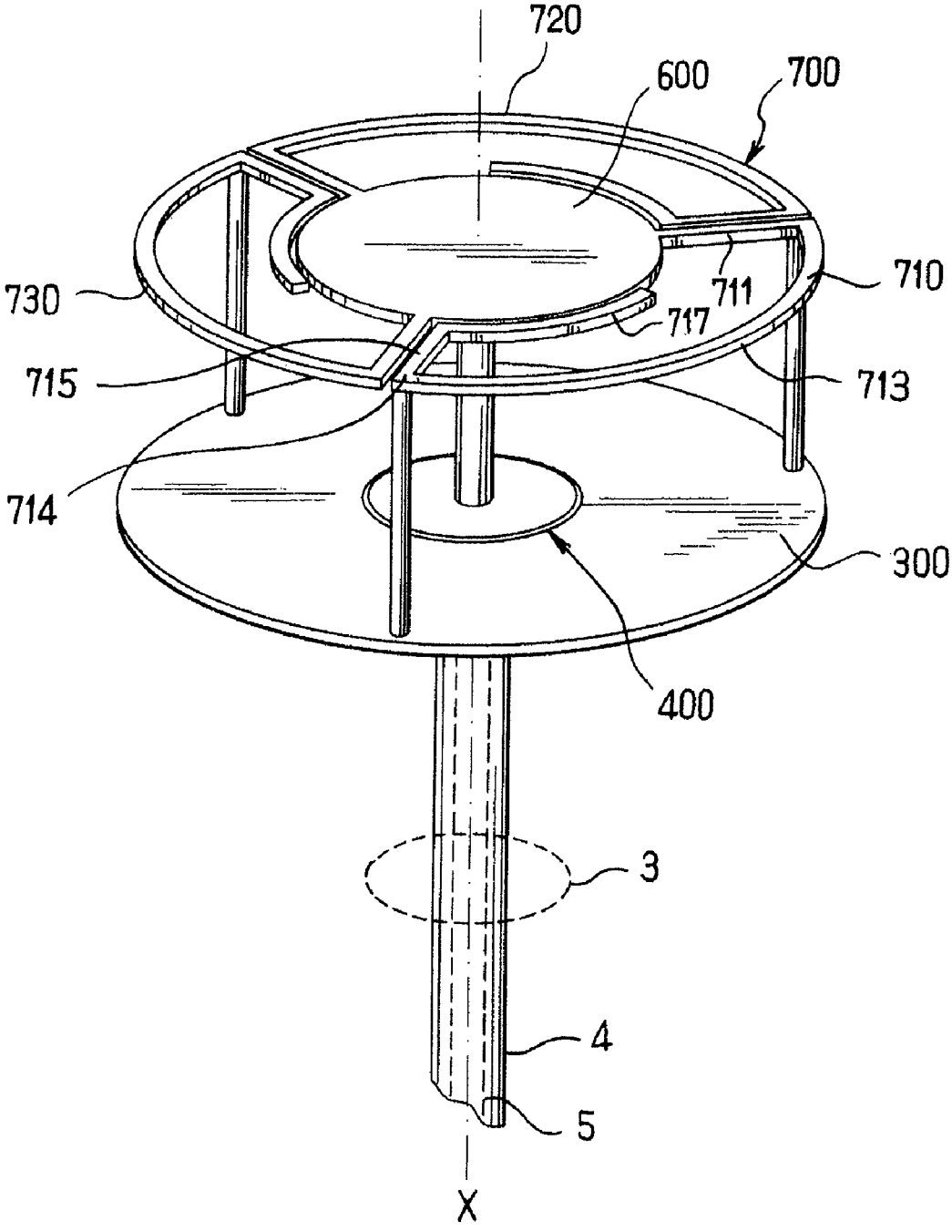
FIG. 2 illustrates in a perspective view an antenna according a second alternative of the invention.

FIG. 2 shows an alternative embodiment of an antenna according to the invention, the structure of which differs from that of FIG. 1 by the proposed set 200 of N radiating strands.

This set 200 comprises three radiating strands 710, 720, 730, each having a shape similar to that of the radiating strand 710 described now.

Unlike the strands illustrated in FIG. 1, the radiating strand 710 has a portion 717 which extends as an additional circular arc.

More specifically, a first portion 713 extends as a circular arc over 120° around the X axis and extends with a rectilinear return branch 715 extending radially towards the disc 600 and stopping in proximity to the latter without touching it.

This return branch 715 initiates a second portion 717 extending as a circular arc 717 over 60° around the disc 600 and running along the latter without any contact.

The two portions extending as a circular arc 713 and 717 respectively turn around the axis X in two opposite directions, i.e. clockwise and anticlockwise.

Figure 3:
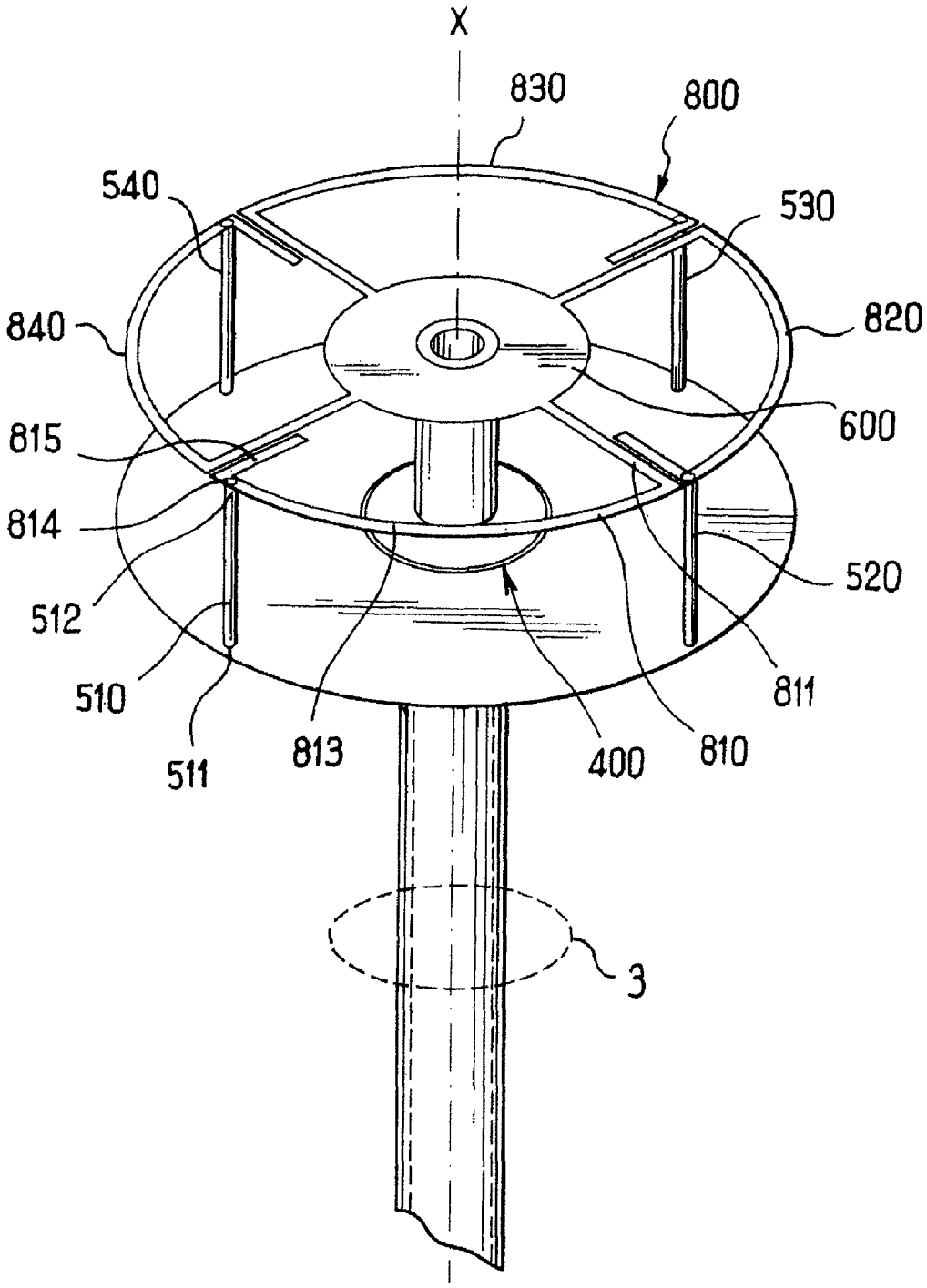
FIG. 3 represents in a perspective view an antenna according to a third alternative of the invention.

FIG. 3, as for it, shows an alternative embodiment of an antenna according to the invention, the structure of which differs from that of FIG. 1 by the proposed shape of N radiating strands, the proposed external antenna support 600 and feed wire 100.

On the one hand, the feed wire 100 is formed with a hollow axisymmetric cylinder centered on the geometrical axis X, said cylinder being in contact, on its outer periphery, with an external antenna support having the shape of a disc 600 pierced at its centre. The diameter of the hole is adjusted in order to receive said cylinder.

On the other hand, unlike the radiating strands illustrated in FIG. 1, the radiating strand 810 here has a portion extending as a circular arc 813 which is extended by a rectilinear return branch 815 extending towards the disc 600 and stopping at half the distance from the latter.

The following is also valid for the set of radiating strands 710, 720, 730, described with reference to FIG. 2.

In FIG. 3, as the radiating strands are placed side by side and have the same clockwise direction, each initial segment connected to the disc 600 is bordered, at its end away from the disc, by a return branch of a neighboring strand, this return branch being, as for it, not connected to the disc 600.

Moreover, a ground return rod for the strands 510 is electrically connected here at a first end 512 to the intersection 814 between the first portion 813, extending as a circular arc and the rectilinear return branch 815, and at the opposite end 511, to the ground plane 300.

Alternative embodiments of the antennas illustrated in FIGS. 2 and 3 provide on the initial segments and/or on the return branches of each radiating strand and/or on the feed wire, meanders with varied shapes and dimensions or not in order to reduce the dimensions of the antenna.

The invention claimed is:

1. An antenna configured to produce an axisymmetric radiation pattern around a geometrical axis and having a radiation maximum in a plane perpendicular to the direction of said axis, the antenna comprising:

a feed wire comprising at least one meander, the feed wire extending along said axis from a first end to a second end, the first end of the feed wire being located in the same plane as a conductive surface forming a ground plane of the antenna and the second end powering a set of N radiating strands, N being an integer, at least one ground return rod for the strands, said rod connecting one of the radiating strands of the set to the ground plane, wherein the set of the N radiating strands is substantially located in a same main plane and each of the radiating strands follows an initial segment extending radially from the geometrical axis, and then extends along a circular arc portion centered on said axis, said ground return rod for the strands being electrically connected at a first end to the end of the circular arc portion of a strand and, at the opposite end, to the ground plane, and the initial segment of each radiating strand comprises at least one meander.

2. The antenna according to claim 1 wherein each meander has a shape selected from the group consisting of a trapezoid, a square, a rectangle, a triangle, and a circular arc.

3. The antenna according to claim 1, further comprising an external antenna support in the form of a disc centered on the axis, connected at its center to the feed wire and at its periphery to each of the N radiating strands of the antenna.

4. The antenna according to claim 1, further comprising an impedance matching circuit in the form of a disc centered on said axis and placed at said first end of the feed wire forming a capacitance with the ground plane (300).

5. The antenna according to claim 1, wherein the antenna is with natural circular polarization or natural linear polarization.

6. The antenna according to claim 1, wherein the set of the radiating strands follows a circular perimeter with a diameter of the order of $0.10\lambda$ to $0.25\lambda$ where $\lambda$ is a predetermined working wavelength of the antenna.

7. The antenna according to claim 1, wherein the total thickness of the antenna defined by the height between the ground plane and the set of the N radiating strands is of the order of $0.02\lambda$ to $0.04\lambda$.

8. The antenna according to claim 1, wherein each radiating strand has a length less than or equal to a half wavelength at a predetermined working frequency of the antenna.

9. The antenna according to claim 1, wherein the antenna is a printed antenna.

10. The antenna according to claim 1, wherein the antenna has a plurality of sets of radiating strands arranged as a stack.

11. The antenna according to claim 1, wherein each meander has a shape selected from the group consisting of a trapezoid, a square, a rectangle, a triangle, and a circular arc.

12. An antenna configured to produce an axisymmetric radiation pattern around a geometrical axis and having a radiation maximum in a plane perpendicular to the direction of said axis, the antenna comprising:

a feed wire comprising at least one meander, the feed wire extending along said axis from a first end to a second end, the first end being located in the same main plane as a conductive surface forming a ground plane of the antenna and the second end powering a set of N radiating strands, N being an integer, at least one ground return rod for the strands, said rod connecting one of the radiating strands of the set to the ground plane, wherein the set of N radiating strands is substantially located in a same main plane and each of the radiating strands follows an initial segment extending radially from the geometrical axis, and then extends along a circular arc portion centered on said axis initiating a return branch extending radially towards said axis, said ground return rod of the strands being electrically connected, at a first end to the intersection of said circular arc portion with said return branch and, at the opposite end, to the ground plane, and at least one of the initial segment and the return branch of each radiating strand comprises at least one meander.

13. The antenna according to claim 12, wherein the feed wire of the strands is formed by a rigid wire comprising at least one meander.

14. The antenna according to claim 13, wherein each meander has a shape selected from the group consisting of a trapezoid, a square, a rectangle, a triangle, and a circular arc.

* * * * *